US006484473B1

(12) United States Patent
Hall

(10) Patent No.: US 6,484,473 B1
(45) Date of Patent: Nov. 26, 2002

(54) METHOD OF FORMING A SUPPORT STRUCTURE USING STRINGS OR STAYS

(76) Inventor: Alethea Rosalind Melanie Hall, Plot 40, Dawn Farm, Driefontein, 1747, Muldersdrift (ZA)

( * ) Notice: Subject to any disclaimer, the term of this patent is extended or adjusted under 35 U.S.C. 154(b) by 0 days.

(21) Appl. No.: 09/701,689

(22) PCT Filed: May 28, 1999

(86) PCT No.: PCT/IB99/00965

§ 371 (c)(1),
(2), (4) Date: Nov. 30, 2000

(87) PCT Pub. No.: WO99/63166

PCT Pub. Date: Dec. 9, 1999

(30) Foreign Application Priority Data

Jun. 1, 1998 (ZA) ..... 98/4685

(51) Int. Cl.[7] ..... E04B 1/00

(52) U.S. Cl. ..... 52/741.1; 405/258; 405/286; 405/17; 428/117; 428/137

(58) Field of Search ..... 404/17, 27, 28, 404/45, 70; 465/302.4, 302.6, 258.1, 229

(56) References Cited

U.S. PATENT DOCUMENTS 4,717,283 A * 1/1988 Bach ..... 405/17
5,160,215 A 11/1992 Jensen
5,449,543 A * 9/1995 Bach et al. ..... 428/117
5,472,297 A * 12/1995 Heselden ..... 405/286
5,927,906 A * 7/1999 Bach et al. ..... 405/258
6,296,924 B1 * 10/2001 Bach ..... 428/137

FOREIGN PATENT DOCUMENTS

| | | |
|---|---|---|
| EP | 0611849 | 8/1994 |
| WO | WO9736057 | 2/1997 |
| WO | WO9716604 | 9/1997 |

* cited by examiner

*Primary Examiner*—Carl D. Friedman
*Assistant Examiner*—Steve M Varner
(74) *Attorney, Agent, or Firm*—Ladas & Parry

(57) ABSTRACT

A method of forming a support structure on a base from a framework (10) comprising a tube (12) of a flexible material divided by dividing walls (14) of a flexible material into an array of compartment (16), is disclosed. The method includes the steps of locating flexible strings (20, 22, 24, 26, 28, 30, 32, 34) through lines of compartments (16) at or near each edge of the framework (10) and through lines of compartments (16) intermediate the edge lines of compartments (16), attaching the ends of the strings (20 to 34) to fixed objects (36) to support the framework (10) with a first end of the tube (12) on the base and a second end of the tube (12) above the first end, and filling some or all of the compartments (16) with a suitable filler material. The strings or stays assist in supporting the framework (10) when it is being filled with the filler material.

11 Claims, 3 Drawing Sheets

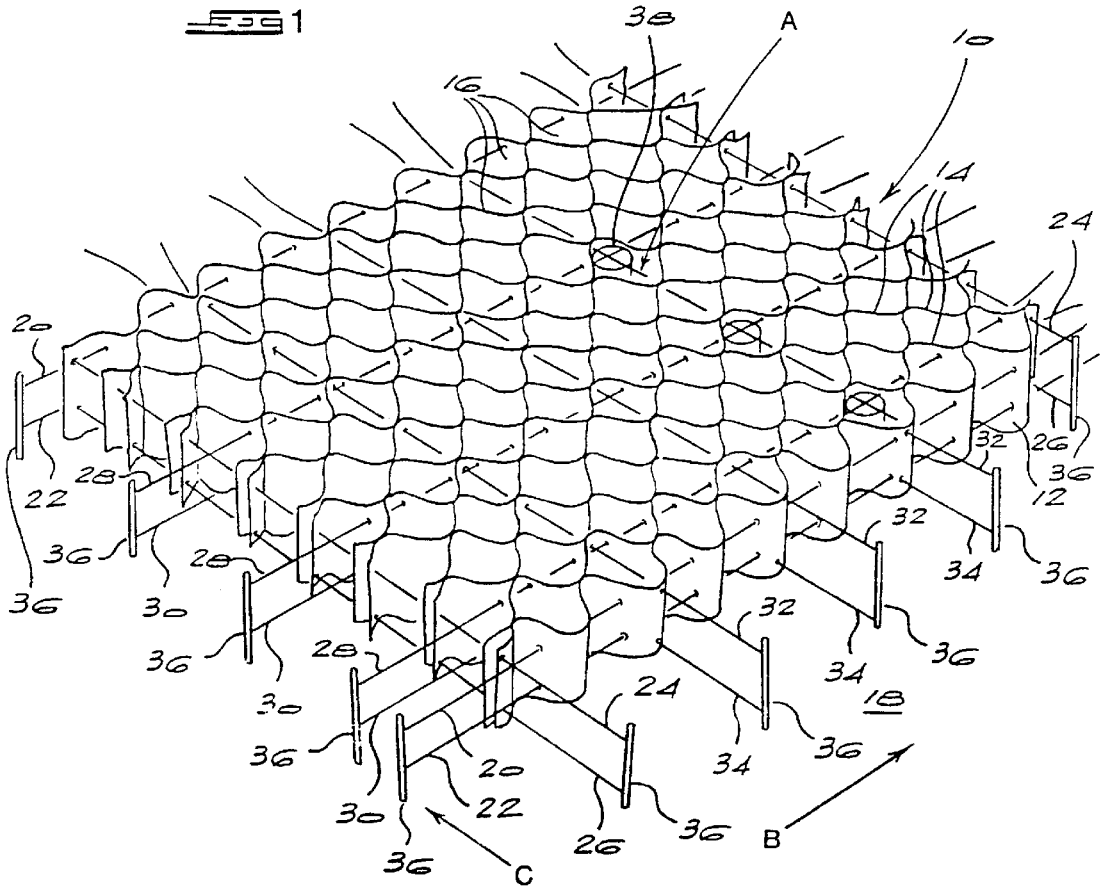
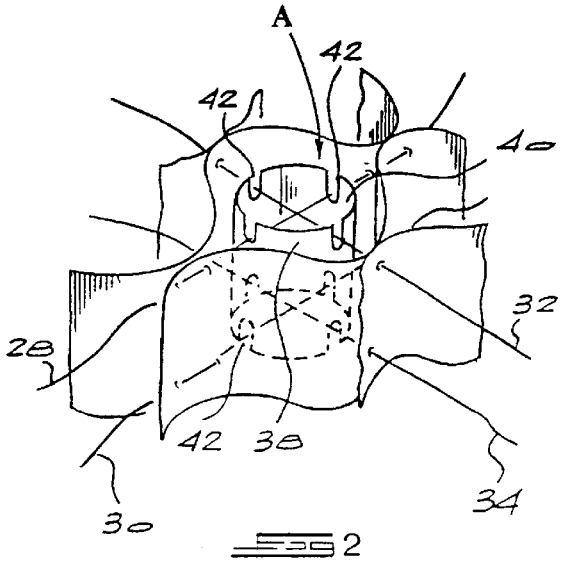
2

METHOD OF FORMING A SUPPORT STRUCTURE USING STRINGS OR STAYS

BACKGROUND TO THE INVENTION

This invention relates to a method of forming a support structure on a base, and to an article for use in forming such a support structure.

It is well known to form support structures such as roadways, canal or river or bank linings, mine packs, sea walls, or the like from a material having a honeycomb structure, i.e having a plurality of compartments or cells divided by dividing walls, each compartment or cell being filled with a suitable filler material. Examples of such materials for use in the support structures are Hyson-Cells from M & S Technical Consultants and Services (Pty) Limited, Geoweb from Presto Products Co, Tenweb from Tenax Corp, Armater from Crow Company, Terracell from Webtec Inc, Envirogrid from Akzo Nobel Geosynthetics Co and Geocells from Kaytech.

In making such a support structure using these materials it is generally been the practice for the material with the honeycomb structure to be located on a base, and thereafter for the compartments or cells of the honeycomb structure to be filled with a suitable filler material. However, it has been found that in certain circumstances when the compartments are being filled with the filler material, the walls of the compartments, being flexible, buckle or collapse, which then causes various additional problems such as the creation of a layer of filler material on top of the cells, sometimes a layer of filler material underneath the cells. and gaps or cracks between adjacent blocks, all of which lead to a support structure which is not suitable to perform the required function. These problems are illustrated schematically in FIG. 4 of the accompanying drawings.

There is thus a need for a method of overcoming this problem.

SUMMARY OF THE INVENTION

According to a first aspect of the invention there is provided a method of forming a support structure on a base from a framework comprising a tube of a flexible material divided by dividing walls of a flexible material into an array of compartments or cells running the length of the tube, the compartments being arranged in rows and columns so that the tube divided by dividing walls has a honeycomb structure, which method comprises the steps of:

(1) locating a flexible string or a rigid stay through a line of compartments at or near each edge of the framework. and optionally locating flexible strings or rigid stays through one or more lines of compartments intermediate the edge lines of compartments;

(2) attaching the ends of the strings or stays to fixed objects to support the framework with a first end of the tube on the base and a second end of the tube above the first end; and (3) filling some or all of the compartments with a filler material so that at least some of the compartments are adjacent one or more other compartments filled with the filler material to support and be supported by the adjacent compartments.

In other words, assuming that the framework is substantially rectangular in plan view, a string or a stay is located at least in a line of compartments at or near each of the four edges of the framework.

The flexible string or rigid stay may be located in position in a line of compartments by making a series of holes in the walls of the compartments in the line, and then passing the flexible string or rigid stay through the holes.

The use of flexible strings or rigid stays assists in holding the framework in position before the filler material is filled into the compartments. By strings is meant any flexible rigging. flexible lacing or similar flexible wire material. By stays is meant any rigid rigging, including rigid wire. rods or pipes, or the like.

Preferably, two flexible strings or rigid stays are located through a line of compartments., one string or stay near the top of the tube and the other string or stay near the bottom of the tube.

Preferably, at any point where a string or a stay intersects with another string or stay in a particular compartment, there is provided a support in the compartment to support the intersecting strings or stays.

Alternatively, the support may be used to support the strings or stays at a location other than at intersections.

The support is preferably a rigid support and may comprise, for example, a hollow cylinder with slots, or a solid rod with grooves cut therein, or a stand with hooks thereon to receive and support the strings or stays.

The framework, i.e the tube and the dividing walls, may be made from any suitable flexible material. Although the material must possess some degree of flexibility, the degree of flexibility may range from very flexible up to semi-rigid. The flexible material may be for example a plastics material such as for example a co-extruded or a bi axially extruded plastics material; a plastics laminate material such as for example a laminate of a plastics material and a metallic material or a textile material; a metallic material; a woven or non-woven textile material; a paper or cardboard material. and the like.

The flexible material is preferably a suitable plastics material.

The framework may have any suitable height and any suitable compartment size. For example. the height of the framework may range from 2 mm to 10 m inclusive, and each compartment may have a wall length of from 5 mm up to 2 m.

The compartments in the framework may have any suitable cross-section. such as square, hexagonal or octagonal, but preferably have a square cross-section, i.e each compartment is defined by four walls of substantially equal lengths.

The filler material may be any suitable filler material such as for example an inert filler material, e.g sand or gravel or the like, or a composition comprising a filler material and a settable binder therefor. Examples of such compositions include:

(i) an inert filler material such as sand or gravel or the like, and a cementitious binder, for example ordinary Portland Cement;

(ii) an inert filler material such as sand or gravel or the like and a bituminous binder;

(iii) a filler material such as soil treated with a suitable chemical composition such as calcium chloride, a lignin sulphonate or an ionic liquid to cause the soil to bind or set;

(iv) a filler material such as sand or gravel or the like and a resin binder, for example (a) a thermosetting resin such as polyurethanes and polyesters, (b) a thermoplastic resin such as polyethylene, EVA, or PVC, and (c) a suitable wax.

The settable composition may include a conventional foam or foaming agent so that the final set composition is a foamed composition, to reduce the weight thereof.

The support structure may be made from a single framework as described above, or the support structure may be made from a plurality of frameworks laid side-by-side on the base, each framework being as described above and being supported as described above and being filled with the filler material as described above In this case, the compartments along an edge of a first framework will abut the compartments along an adjacent edge of an adjacent framework.

According to a second aspect of the invention there is provided a combination of a framework comprising a tube of a flexible material divided by dividing walls of a flexible material into an array of compartments or cells running the length of the tube. the compartments being arranged in rows and columns so that the tube divided by diving walls has a honeycomb structure, and a plurality of flexible strings or rigid stays each located in a line of compartments, the combination including a flexible string or rigid stay at or near each edge of the framework, for use in forming a support structure by the method described above.

The flexible strings or rigid stays are typically attached to fixed structures or are themselves supported on rigid auxiliary support members, such as soil nails or anchoring pegs or the like.

Each flexible string or rigid stay tray be provided with holding means, to hold the string or stay in position in the framework, i.e to prevent the string or stay from being pulled out of the row or column of compartments in which it is located.

For example, a flexible string may be knotted within a compartment or outside an edge compartment, to prevent the string from being pulled out of the relevant compartment. Alternatively a suitable holding means such as a plate with a hole therethrough or a mesh, may be located in a compartment, with the flexible string or rigid stay passing through the hole in the plate or a hole in the mesh and being ripped thereby.

BRIEF DESCRIPTION OF THE DRAWINGS

FIG. 1 is a perspective view of a combination of a framework and a plurality of flexible strings, for use in the method of the invention;

FIG. 2 is an enlarged view of a compartment marked A in FIG. 1;

DESCRIPTION OF EMBODIMENTS

Figure 4:
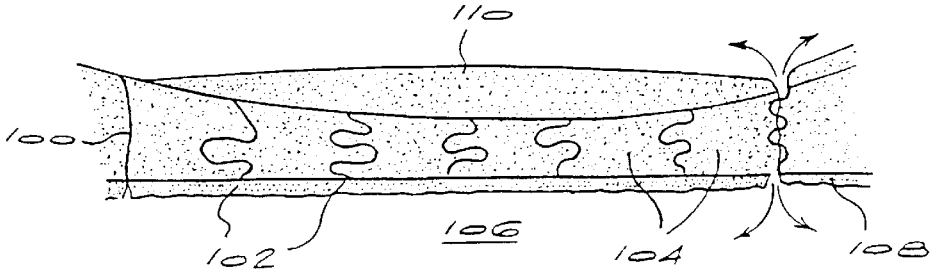
FIG. 4 is a schematic view of a prior art system illustrating the potential problems when flexible strings or rigid stays are not used.

Before dealing with the present invention. the prior art will be described in more detail with reference to FIG. 4. FIG. 4 illustrates what can happen when using a framework 100 comprising a tube of a flexible material divided by dividing walls 102 of a flexible material into an array of compartments 104. It can be seen that the framework 100 is unsupported but is simply placed on a base 106. The compartments 104 are then filled with a suitable filler material. As the framework 100 is unsupported, some of the filler material flows underneath the ends of the walls 102 and forms a layer 108. Further, as more of the filler material is poured onto the framework 100, the walls 102 may begin to buckle as illustrated. This is particularly the case when the material from which the framework is made is very flexible. Thereafter. as the compartments 104 can no longer receive filler material, a layer 110 of filler material forms on the top of the compartments 104. The net result of this is that the support structure so formed will be liable to uncontrolled cracking. Such uncontrolled cracking may reduce any interlocking of adjacent compartments so that the support structure can no longer sustain the required load. In addition, assuming that the support structure is intended to perform some water proofing function, uncontrolled cracking can reduce the waterproofness of the support structure.

The first aspect of the invention is a method of forming a support structure on a base. and this method will be described in more detail with reference to FIGS. 1 and 2.

Referring to FIG. 1 there is shown a framework 10 comprising a tube 12 of a flexible material divided by dividing walls 14 of a flexible material into an array of compartments 16 running the length of the tube 12. The compartments 16 are arranged in rows running in the direction of the arrow B and columns running in the direction of the arrow C, so that the tube 12 divided by dividing walls 14 has a honeycomb structure as shown.

The framework 10 is used to for support structure on a base 18 as follows. Firstly. two flexible strings 20, 22 are located through a line of compartments 16 being the outer rows of the array. Thereafter. two flexible strings 24, 26 are located through a line of compartments 16 being the outer columns of the array. In addition, flexible strings 28, 30 in rows and 32, 34 in columns are located respectively in rows intermediate the outer rows and in columns intermediate the outer columns.

Secondly, the ends of the strings 20, 22, 24, 26, 28, 30, 32, 34 are tied to pegs 36 to hold the framework 10 in position with an end of the tube 12 on the base 18 and a second end of the tube 12 above the first end, as illustrated.

Thirdly, at points where strings 28, 30 intersect with strings 32, 34 in a particular compartment (for example compartment A) a support 38 is located in the compartment A to support the intersecting strings 28, 30, 32, 34, as is illustrated in FIG. 2. The support 38 comprises a hollow cylinder 40 which includes a series of slots 42 for receiving the intersecting strings 28, 30, 32, 34 so as to support the strings while the filler material is filled into the compartments 16. Instead of a hollow cylinder 40, the support 38 may comprise a solid rod with grooves replacing slots 42, or a stand, optionally with folding legs, and carrying a plurality of hooks which replace the slots 42. Further, the supports are not limited to intersections and may be used at locations other than intersections.

Once the framework 10 and plurality of strings 20 to 34 are in position, and the supports 38 are in position, some or all of the compartments 16 are filled with a filler material so that at least some of the compartments 16 are adjacent one or more other compartments 16 filled with a filler material to support and be supported by the adjacent compartments 16, to form the support structure.

The main advantage of this method of the invention is that the flexible strings 20 to 34 support the framework 10 prior to introduction of the filler material, and prevent the tube 12 from collapsing as the filler material is poured into the compartments 16. The flexible strings 20 to 34 also hold the framework 10 down on the base 18, so that a layer of filler material cannot form under the framework 10 and cause it to separate from the base 18. These dangers are illustrated in FIG. 4.

In addition, the use of the supports 38 means that the framework 10 and supporting structure made therefrom, can be placed on an impervious layer or a membrane, without damaging the layer or membrane, which is important in the manufacture of waterproof linings and the like For example when the filler material is a "wet" concrete with a high slump, then there is a tendency for the framework 10 to "float", and the strings 20 to 34 help to hold the framework 10 down on the base 18 to prevent this. On the other hand when the filler material is a "stiff" concrete with a lower slump value, then there is a tendency for the compartments 16 to collapse, and the strings 20 to 34 help to prevent this.

Once the compartments 16 are filled with the filler material, the pegs 36 may optionally be removed, and a second support structure may be formed in a similar manner adjacent a side of the first support structure, in exactly the same manner.

In FIG. 1, the strings 20 to 34 are illustrated as being tied to pegs 36. However, the strings 20 to 34 may be tied to any suitable fixed objects, for example a previously formed support structure, or the base 18 itself or the like.

It is to be noted that in the framework 10 of FIG. 1, two strings (e.g 20, 22) are located in each line of compartments 16. In certain cases it will be sufficient to use only one string in each line of compartments.

If desired. suitable holding means may be attached to the strings 20 to 34 to prevent them from being pulled out of the rows and columns of compartments 16. This is illustrated in more detail in FIG. 5.

The strings 20 to 34 are located in the compartments 16 by making a series of holes in the walls 14 of the compartments 16 in a line, and then passing the strings 20 to 34 through the holes. For example, after manufacture of the framework 10, the framework 10 may be flattened and holes made in the walls 14 of the compartments 16 to accommodate the strings 20, 22, 28, 30. Thereafter the framework 10 may be pulled open and then flattened in the transverse direction and holes made in the walls 14 of the compartments 16 to accommodate the strings 24, 26, 32, 34.

Figure 3:
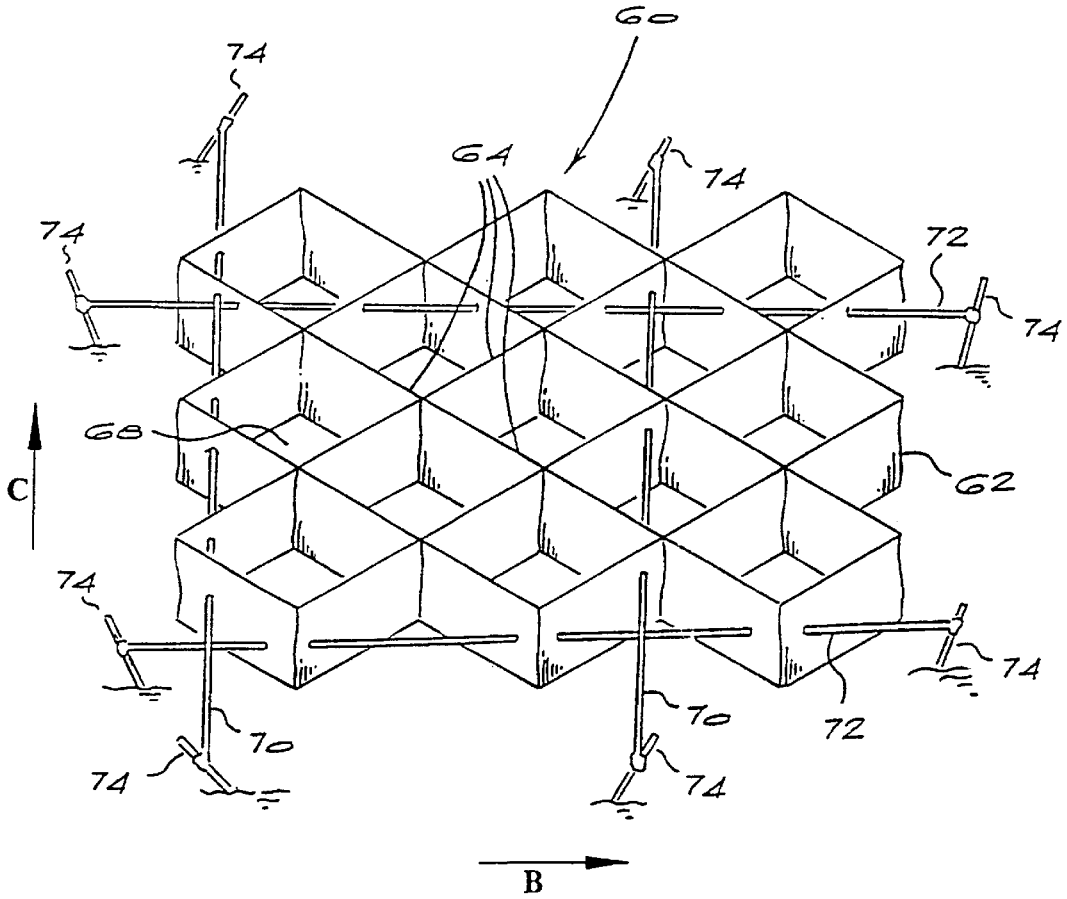
FIG. 3 is a perspective view of a combination of a framework and a plurality of rigid stays, for use in the method of the invention.

Referring to FIG. 3, the method of the invention is again illustrated, but using rigid stays rather than flexible strings. Thus referring to FIG. 3 there is shown a framework 60 comprising a tube 62 of a flexible material divided by dividing walls 64 into an array of compartments 68 running the length of the tube 62. The compartments 68 are arranged in rows running in the direction of the arrow B and columns running in the direction of the arrow C, so that the tube 62 divided by dividing walls 64 has a honeycomb structure as shown.

The framework 60 is held in position by means of rigid stays 70, 72 running through the lines of compartments 68. The rigid stays 70, 72 are themselves held in position by being attached to suitable pegs 74. Once the framework 60 and plurality of rigid stays 70, 72 are in position some or all of the compartments 68 may be filled with a filler material as described above.

The rigid stays 70, 72 may be rigid wires, rods or tubes, which are preferably non-corroding, e.g galvanised wire. When the rigid stays 70, 72 are rods or tubes, then the rigid stays 70, 72 serve the added function of providing reinforcing to the support structure.

Figure 5:
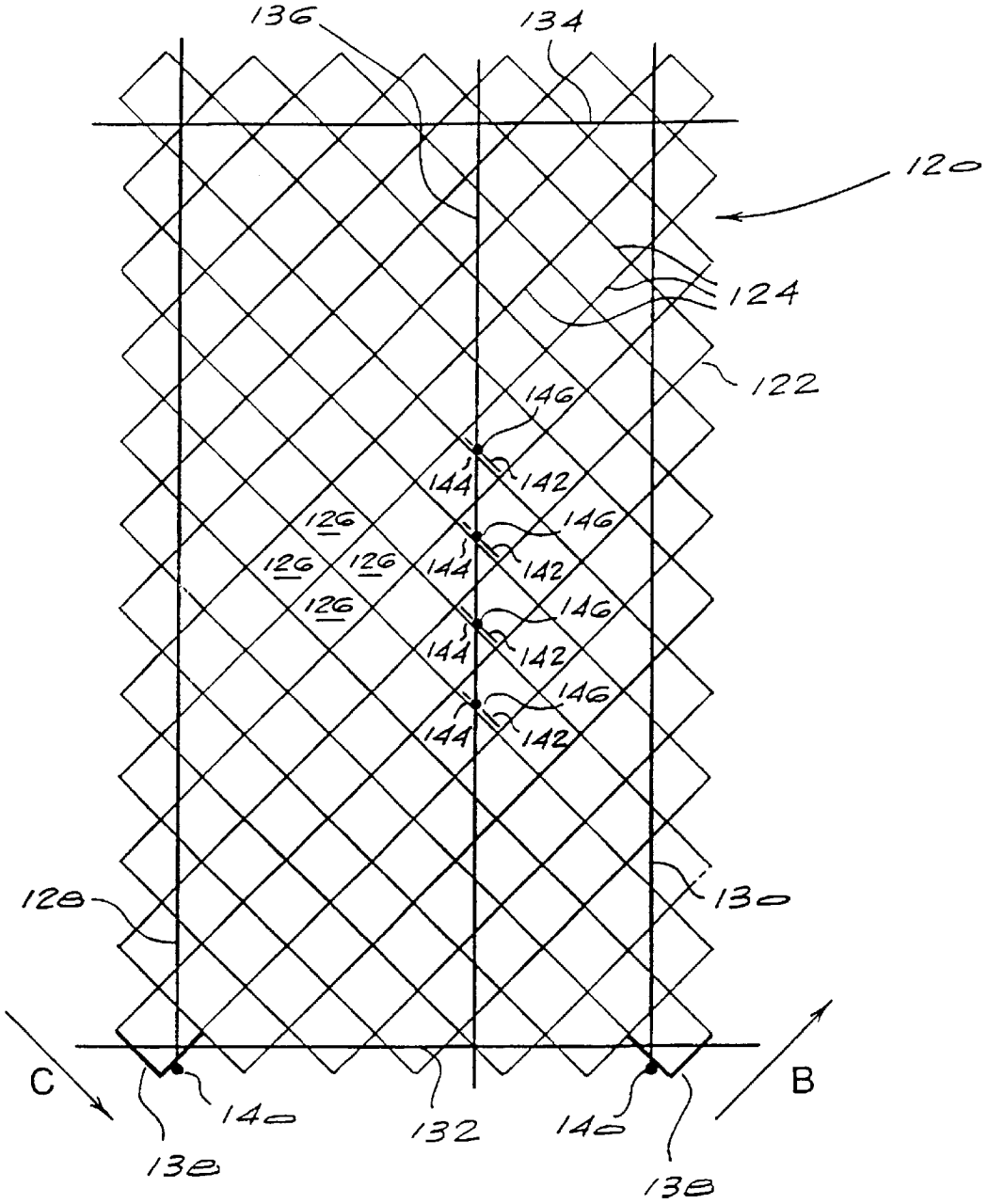
FIG. 5 is a schematic plan view of another combination of a framework and a plurality of flexible strings, for use in the method of the invention.

Referring to FIG. 5 there is shown a framework 120 comprising a tube 122 of a flexible material divided by dividing walls 124 into an array of compartments 126 running the length of the tube 129. The compartments 126, are arranged in rows running in the direction of the arrow B and columns running in the direction of the arrow C, so that the tube 122 divided by dividing walls 124 has a honeycomb structure as shown. The framework 120 is held in position by means of flexible strings 128, 130, 132, 134 and 136 running through the lines of compartments 126 as illustrated.

The strings 128, 130 are held in position in their respective lines of compartments 126 by means of plates 138 located on the outside of the framework 120, with the strings 128, 130 being secured at 140 to the plates 138. In this way, the strings 128, 130 are prevented from being pulled through and out of the framework 120.

The string 136 is associated with a series of plates 142, each plate 142 including a hole 144 threrethrough. The string 136 is secured in each compartment 126 by means of knots 146 which prevent the strip 136 from being pulled out of the line of compartments 126.

Instead of the plates 142, there may be used a mesh including a plurality of holes therethrough, again with the string 136 being retained in each compartment 126 by means of the mesh.

The use of plates 138 or 142 may particularly be considered when it is desired to tie a first section of the framework 120, filled for example with concrete, to a second section of the framework 120, filled for example with landfill or the like.

As indicated above, generally when forming a support structure, a number of frameworks will be placed side-by-side on the base, with each framework being supported by flexible strings or rigid stays as described above, and then each framework will be filled with a filler material as described above. In this way, adjacent compartments of one framework abut adjacent edge compartments of an adjacent framework, to form the support structure with the desired features.

The use of flexible strings or rigid stays also allows a support structure to be formed on sloping or curved bases. For example a support structure of the invention may be a pond lining, with the bottom and sides of the pond covered by the support structure and with the support structure continuing over the lip of the pond, to increase the waterproofness of the support structure.

The support structure formed according to the method of the invention may be for example a roadway or a paved area: a lining for a canal, river, drain or spillway or the like; a support for an embankment; a dam or harbour wall; or any other suitable support structure.

This method is of particular application for the production of structures such as roads, canals, drains and spillways, which are subject to shear forces.

The method of the invention may also be used to make a structure such as a water purification pack where the compartments of the framework contain a suitable filter material.

What is claimed is:

1. A method of forming a support structure on a base from a framework comprising a tube of a flexible material divided by dividing walls of a flexible material into an array of compartments running the length of the tube, the compartments being arranged in rows and columns so that the tube divided by dividing walls has a honeycomb structure, which method comprises the steps of:

1) locating a flexible string or a rigid stay through a line of compartments at or near each edge of the framework, and optionally locating flexible strings or rigid stays through one or more lines of compartments intermediate the edge lines of compartments;

2) attaching the ends of the strings or stays to fixed objects to support the framework with a first end of the tube on the base and a second end of the tube above the first end;

3) locating in one or more of the compartments a support to support a string or a stay passing through that compartment; and 4) filling some or all of the compartments with a filler material so that at least some of the compartments are adjacent one or more other compartments filled with the filler material to support and be supported by the adjacent compartments.

2. A method according to claim 1 wherein two flexible strings or rigid stays are located through a line of compartments, one string or stay near the top of the tube and the other string or stay near the bottom of the tube.

3. A method according to claim 1 wherein at any point where a string or a stay intersects with another string or a stay in a compartment, there is provided a support in the compartment to support the intersecting strings or stays.

4. A method according to claim 1 wherein the support is selected from a group consisting of a hollow cylinder with slots to receive and support the strings or stays, a solid rod with grooves cut therein to receive and support the strings or stays, and a stand with hooks thereon to receive and support the strings or stays.

5. A method according to claim 1 wherein the framework is made from a flexible material selected from the group consisting of a plastics material, a plastics laminate material, a metallic material, a woven or non-woven textile material, or a paper or cardboard material.

6. A method according to claim 1 wherein there is used flexible strings only.

7. A method according to claim 1 wherein there is used rigid stays only.

8. A method according to claim 1 wherein the filler material includes a settable binder.

9. A method according to claim 8 wherein the settable binder is a cementitious binder.

10. A method according to claim 1 wherein each flexible string or rigid stay is provided with holding means to hold the string or stay in position in the framework.

11. A method according to claim 1 wherein the support structure is formed from a plurality of frameworks laid side-by-side on the base, the compartments along an edge of a first framework abutting the compartments along an adjacent edge of an adjacent framework, to form the support structure.

* * * * *